United States Patent [19]

Lundborg et al.

[11] 4,265,177

[45] May 5, 1981

[54] DEVICE IN BLASTING CAP FOR LOW-ENERGY FUSE

[75] Inventors: Hans Lundborg; Leif Kristensen; Stig Nyqvist, all of Nora, Sweden

[73] Assignee: Nitro Nobel AB, Gyttorp, Sweden

[21] Appl. No.: 23,608

[22] Filed: Mar. 26, 1979

[30] Foreign Application Priority Data

Apr. 7, 1978 [SE] Sweden ..... 7803931

[51] Int. Cl.[3] ..... C06C 7/00

[52] U.S. Cl. ..... 102/275.9; 102/275.5

[58] Field of Search ..... 102/24 R, 27 R, 29

[56] References Cited

U.S. PATENT DOCUMENTS

| | | | |
|---|---|---|---|
| 791,100 | 5/1905 | Keith et al. | 102/29 |
| 1,623,664 | 4/1927 | Eschbach | 102/29 |
| 2,618,221 | 11/1952 | Lowe | 102/29 |
| 3,610,151 | 10/1971 | Nett | 102/29 |
| 3,776,135 | 12/1973 | Zebree | 102/29 |
| 3,817,181 | 6/1974 | Persson et al. | 102/29 |
| 3,895,577 | 7/1975 | Zebree | 102/29 |
| 3,981,240 | 9/1976 | Gladden | 102/29 |

FOREIGN PATENT DOCUMENTS

| | | | |
|---|---|---|---|
| 506018 | 8/1930 | Fed. Rep. of Germany | 102/29 |
| 119782 | 6/1969 | Sweden . | |
| 75092155 | 8/1975 | Sweden . | |
| 77074268 | 6/1977 | Sweden . | |
| 77076198 | 6/1977 | Sweden . | |
| 576219 | 3/1946 | United Kingdom | 102/29 |
| 978904 | 1/1965 | United Kingdom . | |
| 1288550 | 9/1972 | United Kingdom . | |
| 1534469 | 6/1977 | United Kingdom . | |
| 1524789 | 9/1978 | United Kingdom . | |

*Primary Examiner*—Peter A. Nelson

*Attorney, Agent, or Firm*—Hane, Roberts, Spiecens & Cohen

[57] ABSTRACT

Improvements for a low energy fuse inserted into a blasting cap wherein the fuse is in the form of a hose and the blasting cap comprises a tubular cover containing an explosive and optionally, a delay detonator. The tubular cover receives the hose so that the end of the hose is in facing relation with the detonator or explosive. A moisture-proof barrier is disposed between the fuse and the explosive or detonator and comprises a diffusion-tight rigid tube inserted into the hose and having a flange extending outside the hose in abutment therewith. A diffusion-tight film or foil covers the flange to seal the interior of the tube and thereby the hose from the interior of the cover. The film or foil is ruptured by the blast wave upon detonation of the hose.

9 Claims, 3 Drawing Figures

DEVICE IN BLASTING CAP FOR LOW-ENERGY FUSE

FIELD OF THE INVENTION

Background

The present invention relates to a device in a blasting cap for a low-energy fuse.

A low-energy fuse consists of a plastic tube or a plastic hose with an outside diameter of usually about 3.00 mm, and an inside diameter of about 1.3 mm. A suitable material for the plastic hose can be Surlyn 1554, which is marketed by DuPont. An explosive is applied to the inside of such plastic hose or plastic tube. The explosive can, for example, be a mixture of cyclotetramethylenetetranitramine and aluminum powder, and the proportion of the mixture can be about 91% of the first substance and about 9% of the other substance. If such a fuse is initiated at one end, a blast wave or a detonation is obtained, thanks to the layer of explosives, which moves from said one end to the other end of the fuse. A blasting cap is arranged in the other end of the fuse, which comprises a cover which is closed at one end with a bottom. A suitable material for the cover is aluminium, plastic or the like. Beginning from the bottom, the cover contains a main explosive charge, which can consist of a mixture of cyclotrimethylenetrinitramine and trinitrotoluene. The mixture proportion can be 85% of the first substance and 15% of the second substance. After the main explosive charge is arranged a primary explosive charge, which usually consists of lead azide.

If required a delay detonator can then be placed, which may consist of a mixture of silicon, silicon dioxide, oxide of lead and ferric oxide. After this, a sealing cover is arranged. The sealing cover is tubular and its outer surface lies true against the cover of the blasting cap. The inside space in the sealing cover serves to make room for the fuse. If the fuse provides the blasting cap with a blast wave or a detonation or perhaps more correctly called a blast wave signal, the delay detonator, primary explosive charge and main explosive charge will be initiated in succession. If no delay detonator is provided, the primary explosive charge will be initiated directly. The hose or tube, of which the fuse is made, must have a certain mechanical power of resistance. If a high degree of mechanical power of resistance is required, it will be difficult to obtain a high tightness of diffusion. If the degree of tightness of diffusion is increased, the mechanical power of resistance is reduced. As the mechanical power of resistance is thus the most important aspect, the hose will allow a certain quantity of moisture to penetrate. This is particularly the case in tropical climates with a constant high humidity and relatively drastic changes in temperature. Moisture which is allowed to enter may affect the explosive in the blasting cap and then especially the delay detonator in such a way that the time, at which the explosion is to take place, is delayed, or the blast wave signal provided to the blasting cap will not be able to initiate the blasting cap.

SUMMARY OF THE INVENTION

An object of the present invention is to make the blasting cap insensitive to moisture which the fuse is subjected because of the required mechanical durability. This is obtained by arranging a moisture-proof barrier in the fuse between the inserted fuse end and the surface of explosive or delay detonator facing this, which moisture-proof barrier protects the surface of the explosives and the surface of the delay detonator, respectively, against moisture.

The moisture-proof barrier, according to the present invention, comprises a transversely arranged film or foil which is diffusion tight. The film or the foil is furthermore of such a nature that it is penetrated by an arriving blast wave. The foil of the film may consist of any suitable material, provided that the foil or the film can be penetrated and is diffusion-tight. A suitable material can be aluminum and steel. If aluminium is used, the film or the foil may have a thickness of 7–20 μm. If the film or the foil is made of steel, the thickness will be under 7 μm.

According to the invention, the film or the foil is placed at the end of a tube made of a rigid material. The tube end is provided with a peripheral flange. The tube with peripheral flange is made of a rigid material, such as aluminium, brass, hard plastic, ceramic material, and the like.

The foil of the film is fixed by means of welding or glueing and it can be bent around the flange.

The tube with flange has an outside diameter corresponding to the inside diameter of the fuse tube, and the tube with flange is inserted so that the flange lies true against the end of the fuse.

The flange at the tube can be chamfered or rounded at its outside edge or edges.

BRIEF DESCRIPTION OF THE DRAWING

The present invention will be described in further detail in connection with the enclosed drawing, wherein.

DETAILED DESCRIPTION

Figure 1:
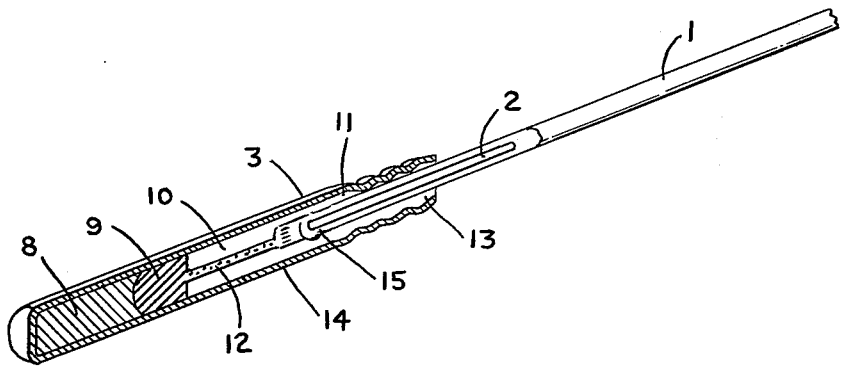
FIG. 1 is a perspective view, partially in section, showing a blasting cap assembled with one end of a tubular fuse, which is coated with explosive or reactive substance.
Figure 2:
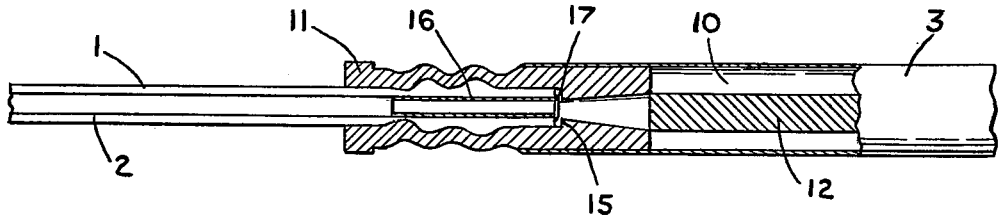
FIG. 2 is a side elevational view, partly broken away and in section showing a similar blasting cap with fuse, and provided with a moisture proof barrier.
Figure 2A:
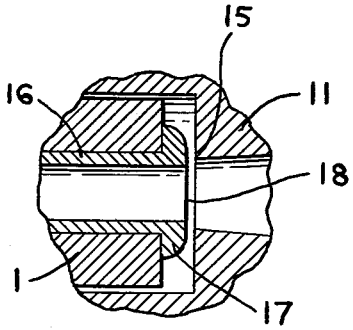
FIG. 2*a* shows a portion of FIG. 2 on an enlarged scale.

In FIGS. 1, 2 and 2*a* number 1 designates a hose of plastic, which is internally coated with an explosive 2,. The hose 1 is inserted into a cover 3 of aluminium, and more particularly, into the top part 13 of a sealing cover 11, which is arranged at the open end of the cover 3. In its top end the cover 3 is corrugated or shrunk to retain the sealing cover 11. The sealing cover 11 is tubular and can suitably be made of rubber. The sealing cover is provided with a constriction 15 between the top part 13 and the bottom part 14. The bottom part 14 abuts against a tubular part 10, which suitably consists of aluminium, and which contains a delay detonator 12. After the delay detonator follows a primary explosive charge 9, which consists of lead azide. After the primary explosive charge follows the main explosive charge 8. As mentioned before, the hose 1 is capable of absorbing moisture, which is transferred further on to the explosive charge which is situated in front of the bottom part 14 of the sealing cover. This moisture has a negative influence on the operation of the blasting cap. For this reason, a moisture-proof barrier consisting of a tube 16 made of a hard material is mounted in the inserted end of the fuse 1. The tube 16 has an outside diameter corresponding to the inside diameter of the fuse 1. The tube 16 can be made of aluminium, brass, plastic or ceramics. At the right end the tube 16 is provided with a peripheral flange 17, the right-hand edge of the flange being chamfered as appears in FIG. *2a*. The flange 17 lies true against the right-hand surface of the transverse edge of the fuse 1. A moisture-proof barrier 18 is placed above the flange. The moisture proof barrier can be bent ground the flange. it can also be fixed to the flange by means of welding or glueing, all dependent on the material selected. The moisture-proof barrier is in the form of a film or foil, and it may consist of metal or any other suitable material, provided that the moisture-proof barrier is diffusion-tight and can be penetrated by a blast wave. The moisture-proof barrier is suitably made of aluminium with a thickness between 7–20 μm. If a moisture proof barrier of steel is selected, the thickness will be under 7 μm. The tube 16 and the flange 17 can be made of aluminium, brass, hard plastic or ceramic material. The advantage of the tube, due to the fact that it is made of a hard material, is that no change in shape will arise concerning the inside diameter of the fuse when the cover 3 is pressed firmly in place, because of the fact that the tube 16 will act as a support during the compression. This is of major importance when the burning velocity of the delay detonator is dependent on pressure. The tube provides each blasting cap with equal conditions.

The membrane of the moisture-proof barrier will also prevent loose explosive in the fuse from dropping on the delay detonator, where the explosive may cause the aluminium cover 3 to blast, which can cause the delay detonator to go out.

Through the present invention it has thus been possible to create a moisture-proof barrier which, is very simple to apply and which in addition, has the advantage that it acts as a support during the compression, gives equal burning conditions, and prevents loose explosives from falling upon the delay detonator.

What is claimed is:

1. The combination comprising a blasting cap and a low energy fuse, the low energy fuse comprising a hose adapted for detonation to transmit a blast wave, the blasting cap comprising a tubular cover having an open end and a closed end, explosive means in said cover, said hose having one end inserted into the open end of the cover in facing relation with said explosive means, and moisture-proof barrier means between said fuse and said explosive means, said moisture-proof barrier means including a diffusion-tight rigid tube inserted into said one end of the hose and a flange on said tube extending outside said hose in proximity with said one end of the hose, and a diffusion-tight film or foil covering said flange to seal the interior of said tube and thereby said hose from the interior of said cover, said film or foil being ruptured by the blast wave upon detonation of said hose.

2. The combination as claimed in claim 1 wherein said explosive means includes a delay detonator.

3. The combination as claimed in claim 2 wherein said tubular cover of said blasting cap includes a sealing cover into which said hose is inserted.

4. The combination as claimed in claim 1 wherein said flange has an outer surface and is provided with a chamfer at said outer surface edge at the periphery of said flange.

5. The combination as claimed in claim 4 wherein said film or foil is bent around said flange.

6. The combination as claimed in claim 1 wherein said film or foil is fastened to said flange.

7. The combination as claimed in claim 1 wherein said hose is selected from the group consisting of aluminum, brass, hard plastic, and ceramic material.

8. The combination as claimed in claim 1 wherein said foil or film is selected from the group consisting of aluminum and steel.

9. The combination as claimed in claim 8 wherein said film or foil has a thickness less than 20 μm.

* * * * *